US006648145B2

(12) United States Patent
Davis et al.

(10) Patent No.: US 6,648,145 B2
(45) **Date of Patent: *Nov. 18, 2003**

(54) V-SHAPED DISC SCREEN AND METHOD OF CLASSIFYING MIXED RECYCLABLE MATERIALS INTO FOUR STREAMS

(75) Inventors: Robert M. Davis, Jamul, CA (US); James D. Weller, San Diego, CA (US)

(73) Assignee: CP Manufacturing, Inc., National City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/232,032

(22) Filed: Aug. 28, 2002

(65) Prior Publication Data

US 2003/0062294 A1 Apr. 3, 2003

Related U.S. Application Data

(63) Continuation-in-part of application No. 09/882,667, filed on Jun. 15, 2001, now Pat. No. 6,460,706.

(30) Foreign Application Priority Data

Jun. 13, 2002 (WO) ..... PCT/US02/18565

(51) Int. Cl.[7] ..... B07B 13/05
(52) U.S. Cl. ..... 209/672
(58) Field of Search ..... 209/672, 673, 209/671, 669

(56) References Cited

U.S. PATENT DOCUMENTS

| | | | | |
|---|---|---|---|---|
| 871,743 A | | 11/1907 | Tice | 209/279 |
| 1,012,046 A | | 12/1911 | Anderson | 209/279 |
| 1,683,918 A | * | 9/1928 | Riddell | 209/672 |
| 1,989,988 A | * | 2/1935 | Jones | 209/672 |
| 2,055,630 A | | 9/1936 | McLean | 209/279 |
| 2,477,006 A | | 7/1949 | Pierson | 209/243 |
| 2,692,046 A | * | 10/1954 | Clary et al. | 209/673 |
| 2,786,574 A | * | 3/1957 | Clark | 209/668 |
| 2,976,550 A | * | 3/1961 | Silver et al. | 15/3.11 |
| 3,306,441 A | * | 2/1967 | Sanders | 209/672 |
| 3,861,516 A | | 1/1975 | Inose et al. | 198/35 |

(List continued on next page.)

FOREIGN PATENT DOCUMENTS

| | | | | |
|---|---|---|---|---|
| CA | 2054615 A | | 5/1992 | B07B/1/00 |
| DE | 439002 | | 1/1927 | 209/672 |
| EP | 173638 | * | 3/1986 | 209/672 |
| SU | 1270-195 A | | 11/1986 | 209/672 |

*Primary Examiner*—Donald P. Walsh
*Assistant Examiner*—Daniel K Schlak
(74) *Attorney, Agent, or Firm*—Michael H. Jester

(57) ABSTRACT

A disc screen apparatus has a V-shaped configuration with a lowermost region that provides a laterally inclined trough that receives the mixed recyclable materials. Broken glass falls downwardly between the discs of the lowermost region. Plastic milk bottles and soda pop containers tumble down the trough and eventually fall off its lower end. Newspaper is conveyed upwardly over the terminal upper ends of a pair of vertically inclined regions of the disc screen apparatus. The frame of the disc screen apparatus can incorporate ducting for connecting a source of pressurized air to one or more air manifolds the blow air toward the vertically inclined regions for helping the discs in these regions convey newspaper up the inclined regions and over their terminal upper ends. The angle of inclination of the vertically inclined regions may be adjustable to optimize the efficiency of classification.

21 Claims, 6 Drawing Sheets

U.S. PATENT DOCUMENTS 4,037,723 A * 7/1977 Wahl et al. ..... 209/672
4,102,502 A * 7/1978 Vaplon et al. ..... 241/4
4,152,402 A * 5/1979 Walters et al. ..... 423/321.2
4,301,930 A * 11/1981 Smith ..... 209/671
4,311,242 A * 1/1982 Hnatko ..... 209/668
4,376,042 A 3/1983 Brown ..... 209/38
4,377,474 A 3/1983 Lindberg ..... 209/279
4,421,021 A * 12/1983 Holbrook ..... 99/504
4,452,694 A 6/1984 Christensen et al. ..... 209/672
4,538,734 A 9/1985 Gill ..... 209/668
4,563,273 A 1/1986 Gessler ..... 210/94
4,579,652 A 4/1986 Bielagus ..... 209/271
4,600,106 A * 7/1986 Minardi ..... 209/662
4,653,648 A 3/1987 Bielagus ..... 209/672
4,658,964 A * 4/1987 Williams ..... 209/552
4,658,965 A 4/1987 Smith ..... 209/672
4,703,860 A 11/1987 Gobel et al. ..... 209/672
4,741,444 A 5/1988 Bielagus ..... 209/672
4,755,286 A 7/1988 Bielagus ..... 209/243
4,781,205 A 11/1988 Shakley ..... 134/131
4,795,036 A 1/1989 Williams ..... 209/667
4,903,845 A 2/1990 Artiano ..... 209/671
5,032,255 A 7/1991 Jauncey ..... 209/38
5,078,274 A 1/1992 Brown ..... 209/44.1
5,116,486 A 5/1992 Pederson ..... 209/12
5,202,133 A 4/1993 Peach et al. ..... 425/83.1
5,234,109 A 8/1993 Pederson ..... 209/12
5,257,699 A 11/1993 Fricker et al. ..... 209/672
5,287,977 A * 2/1994 Tirschler ..... 209/673
5,298,119 A 3/1994 Brown ..... 162/55
5,480,034 A 1/1996 Kobayashi ..... 209/667
5,503,712 A 4/1996 Brown ..... 162/55
5,836,527 A 11/1998 Irwin et al. ..... 241/49
6,250,478 B1 * 6/2001 Davis ..... 209/672
6,318,560 B2 11/2001 Davis ..... 209/672
2001/0004059 A1 * 6/2001 Davis ..... 209/672

* cited by examiner

V-SHAPED DISC SCREEN AND METHOD OF CLASSIFYING MIXED RECYCLABLE MATERIALS INTO FOUR STREAMS

CROSS-REFERENCE TO RELATED APPLICATIONS AND PRIORITY CLAIMS

This application claims priority of pending PCT application Serial No. PCT/US02/18565 filed Jun. 13, 2002, and it is a continuation-in-part of co-pending U.S. application Ser. No. 09/882,667 filed Jun. 15, 2001 entitled "Disc Screen Apparatus with Air Manifold," which issued as U.S. Pat. No. 6,460,706 B1 on Oct. 8, 2002, the entire disclosure of which is hereby incorporated by reference. Said PCT was filed in English and has not yet been published under PCT Article 21(2).

FIELD OF THE INVENTION

The present invention relates to machines for processing mixed recyclable materials, and more particularly, to disc screen apparatus suited for separating paper from a stream of mixed recyclable materials.

BACKGROUND OF THE INVENTION

Material recycling has become an important industry in recent years due to decreasing landfill capacity, environmental concerns and dwindling natural resources. Many industries and communities have adopted voluntary and mandatory recycling programs for reusable materials. Solid waste and trash that is collected from homes, apartments or companies often combine several recyclable materials into one container. When brought to a processing center, the recyclable materials are frequently mixed together in a heterogenous mass of material. These mixed recyclable materials include newspaper, magazines, mixed paper, cardboard, aluminum cans, plastic bottles, glass bottles and other materials that may be recycled.

Disc apparatus or "disc screens" are increasingly used to separate streams of mixed recyclable materials into respective streams or collections of similar materials. This process is referred to as "classifying", and the results are called "classification". A disc screen typically includes a frame in which a plurality of rotatable shafts are mounted in parallel relationship. A plurality of discs are mounted on each shaft and a chain drive commonly rotates the shafts in the same direction. The discs on one shaft interleave with the discs on each adjacent shaft to form screen openings between the peripheral edges of the discs. The size of the openings determines the dimension (and thus the type) of material that will fall through the screen. Rotation of the discs, which have an irregular outer contour, agitates the mixed recyclable materials to enhance classification. The rotating discs propel the larger articles which are too big to fall between the discs across the screen. The general flow direction extends from an input area where the stream of material pours onto the disc screen to an output where the larger articles pour off of the disc screen. The smaller articles fall between the discs onto another disc screen or a conveyor, or into a collection bin.

There is a substantial market for recycled newspaper. Therefore, it is important that any disc screen which is designed to classify mixed recyclable materials be capable of thoroughly separating newspaper from the heterogenous mass of material. Prior disc screen apparatus designed to handle a stream of mixed recyclable materials have included multiple overlapping disc screens with different angles of inclination and different sizes of openings between the discs. They are capable of separating broken glass from containers. They are also capable of separating mixed paper and newspaper from the stream of mixed recyclable materials. These apparatus can be tilted at various angles to improve the efficiency of separation. However, a consistent problem that has been encountered with disc screen apparatus that is used to classify mixed recyclable materials is the fact that newspaper sometimes rolls into a clump or mass midway up the final disc screen and will not be ejected off of the upper terminal end thereof If the angle of inclination of the final disc screen is reduced, then containers and bottles will be undesirably conveyed up the final disc screen and off of its discharge end. This problem is exacerbated where the newspaper is wet or damp.

Most disc screen apparatus that have been developed for classifying mixed recyclable materials have used a flat, generally planar disc screen. The stream of mixed recyclable material is conventionally deposited toward the lower end of the screen along a conveying direction which is generally perpendicular to that of the shafts. The screen is typically inclined and much of the material swirls at the location of deposit. Paper tries to move upwardly as containers try to roll rearwardly and this conflict in flow directions inherently limits the throughput of the screening apparatus. The efficiency of the classification process is also significantly impeded by this conflict in flow directions. Furthermore, it has sometimes been necessary to install multiple blowers along the relatively wide lower end of the disc screen in order to prevent paper from falling off the same.

SUMMARY OF THE INVENTION

In accordance with the present invention a disc screen apparatus has a V-shaped configuration with a lowermost region that provides a laterally inclined trough that receives the mixed recyclable materials. Broken glass falls downwardly between the discs of the lowermost region. Large articles, such as plastic milk bottles and soda pop containers, tumble down the trough and eventually fall off its lower end. Newspaper is conveyed upwardly over the terminal upper ends of a pair of vertically inclined regions of the disc screen apparatus. In the preferred embodiment, the frame of the disc screen apparatus incorporates ducting for connecting a source of pressurized air to one or more air manifolds that blow air toward the vertically inclined regions of the disc screen apparatus for helping the discs in these regions convey newspaper up the inclined regions and over their upper ends. The angle of inclination of the vertically inclined regions is preferably adjustable with a lifting mechanism in order to optimize the efficiency of classification of the V-shaped disc screen apparatus.

DESCRIPTION OF THE PREFERRED EMBODIMENTS

Figure 1:
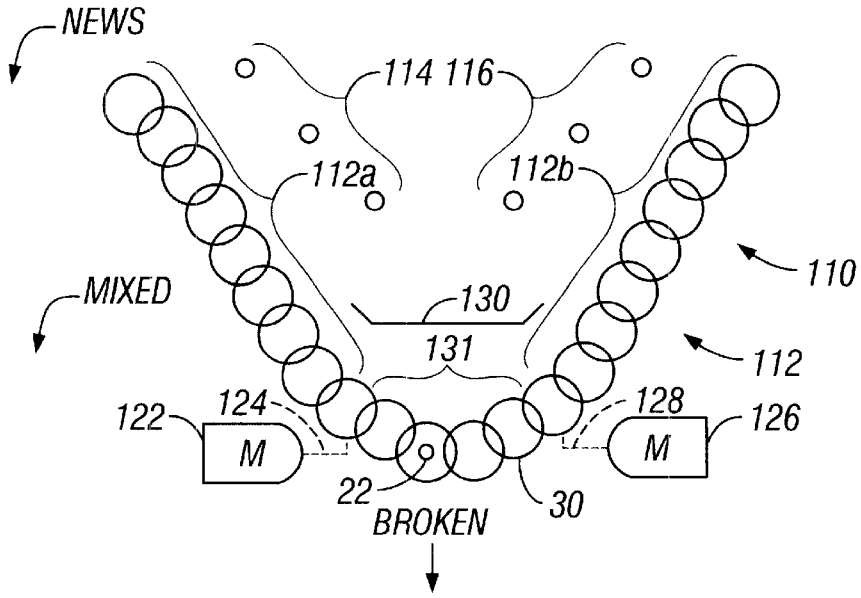
FIG. 1 is a diagrammatic side elevation view of a first embodiment of the present invention.
Figure 2:
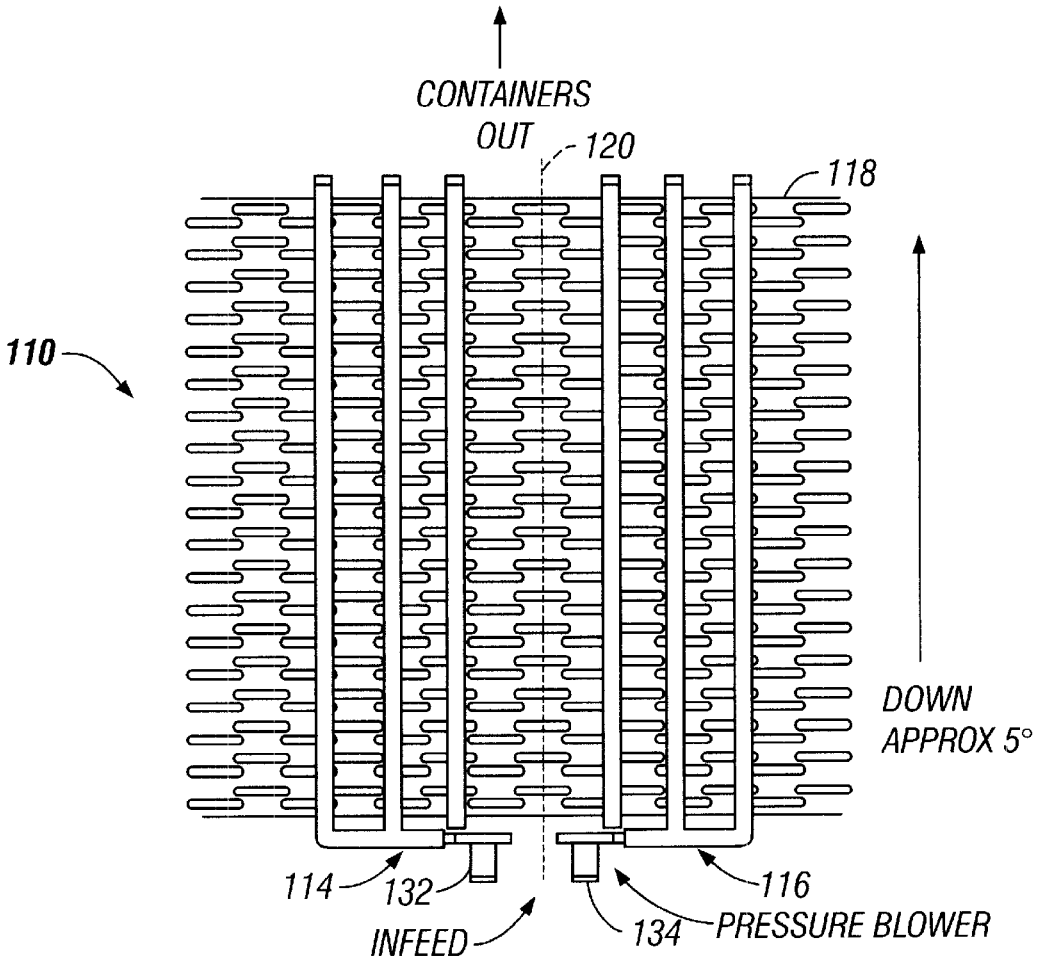
FIG. 2 is a fragmentary top plan elevation view of the first embodiment embodiment.

Referring to FIG. 1, a first embodiment of the present invention comprises a recycling apparatus 110 in the form of a trough-shaped disc screen 112 equipped with a pair of separate air manifolds 114 and 116. Referring to FIG. 2, the recycling apparatus 110 includes a frame 118 that rotatably supports a plurality of laterally extending shafts 22 that spin about laterally extending axes such as 120. The shafts 22 of the trough-shaped disc screen 112 are longitudinally spaced and are located at progressive heights to provide a generally V-shaped configuration as best seen in FIG. 1. The shaft that rotates about the axis 120 (FIG. 2) and the additional shafts to the left of axis 120 are rotated by a motor 122 through a drive linkage 124 in a counter-clockwise direction in FIG. 1. The shafts to the right of the axis 120 (FIG. 2) are rotated by another motor 126 (FIG. 1) via a drive linkage 128 to rotate the discs 30 on these shafts in a clockwise direction in FIG. 1. The drive linkages 124 and 128 preferably each include a plurality of sprockets as described hereafter which are mounted to the ends of the shafts 22 and a plurality of separate chains (not illustrated) entrained about these sprockets. Sprockets (not illustrated) are also mounted on separate gear reduction assemblies (not illustrated) driven by each of the motors 122 and 126. The shafts 22 could be driven directly or indirectly with gears, belts, chain drives, transmissions, electric motors, hydraulic motors, internal combustion engines, and various combinations of these drive means.

A stream of mixed recyclable materials is carried by a conveyor 130 (FIG. 1) and deposited onto a lowermost region 131 of the trough-shaped disc screen 112. While the discs 30 are referred to as "discs" they preferably have an irregular outer contour or shape so that when all of the shafts 22 of the recycling apparatus 110 are rotated, mixed recyclable materials deposited thereon will be agitated and moved along in various conveying directions. In accordance with well know techniques, the spacing of the discs 30 and the resulting dimensions of the openings therebetween determines the size of the materials that will fall downwardly between the discs 30.

The shafts of the lowermost region 131 are preferably slightly downwardly angled from the horizontal, at an angle, for example, of about five degrees. The spacing of the discs 30 along the various shafts of the trough-shaped disc screen 112 and the angle of vertical inclination of the two vertically inclined regions 112*a* and 112*b* of the disc screen 112, along with the rotational speed of these discs, is selected to optimumly classify the stream of mixed recyclable materials infed from the conveyor 130.

Optimum classification by the recycling apparatus 110 is enhanced by the air manifolds 114 and 116 which are connected to squirrel cage blowers 132 and 134 (FIG. 2). The manifolds 114 and 116 may be formed of segments of plastic or metal pipe with holes bored therein at intervals to form nozzles that eject streams of air toward the discs 30 to press newspaper against the discs and aid in the discs 30 conveying the same upwardly. Preferably the streams of air are inclined to help advance the newspaper upwardly. Each of the air manifolds 114 and 116 includes a plurality of laterally extending and longitudinally spaced conduits each having a plurality of laterally spaced nozzles. The conduits are coupled to a longitudinally extending header, the headers being connected to respective ones of the blowers 132 and 134. These conduits are positioned sufficiently close to the first and second vertically inclined regions 112*a* and 112*b* so that containers that are partially conveyed upwardly along the first and second vertically inclined regions 112*a* and 112*b* can tumble over the first and second air manifolds 114 and 116. Other sources of pressurized air besides the squirrel cage blowers 132 and 134 may be utilized, such as fans, pumps, pressurized tanks, and so forth.

The lateral spacing between the discs 30 of the lowermost region 131 is less than the lateral spacing between the discs 30 of the vertically inclined regions 112*a* and 112*b*. Broken glass falls downwardly between the discs 30 of the lowermost region 131 of the trough-shaped disc screen 112. Mixed recyclable materials fall through the discs 30 located along the intermediate portions of the vertically inclined regions 112*a* and 112*b*. Newspaper is conveyed upwardly over the output ends at the upper terminal ends of the vertically inclined regions 112*a* and 112*b*. Large articles such as plastic milk bottles and soda pop containers tumble down the vertically inclined regions 112*a* and 112*b* of the V-shaped disc screen 112 and eventually fall off of the side of the recycling apparatus 110. Preferably the axes of the shafts 22 of the inclined region 112*a* all extend in a first common plane and the axes of the shafts of the inclined region 112*b* all extend in a second common plane.

Thus a stream of mixed recyclable materials is conveyed onto one side of the V-shaped disc screen 112 by the conveyor 130 at the end marked "INFEED" in FIG. 1 and large articles are conveyed out the other side of the V-shaped disc screen 112 at the side marked "CONTAINERS OUT" in FIG. 1.

Persons skilled in the art of designing recycling apparatuses will be well familiar with the various mechanical details necessary to construct the recycling apparatus 110 as well as the individual discs 30 and the bearing assemblies that support the square shafts 22. Such additional details may be found in my U.S. Pat. No. 6,318,560 granted Nov. 20, 2001, the entire disclosure of which is specifically incorporated herein by reference.

Figure 3:
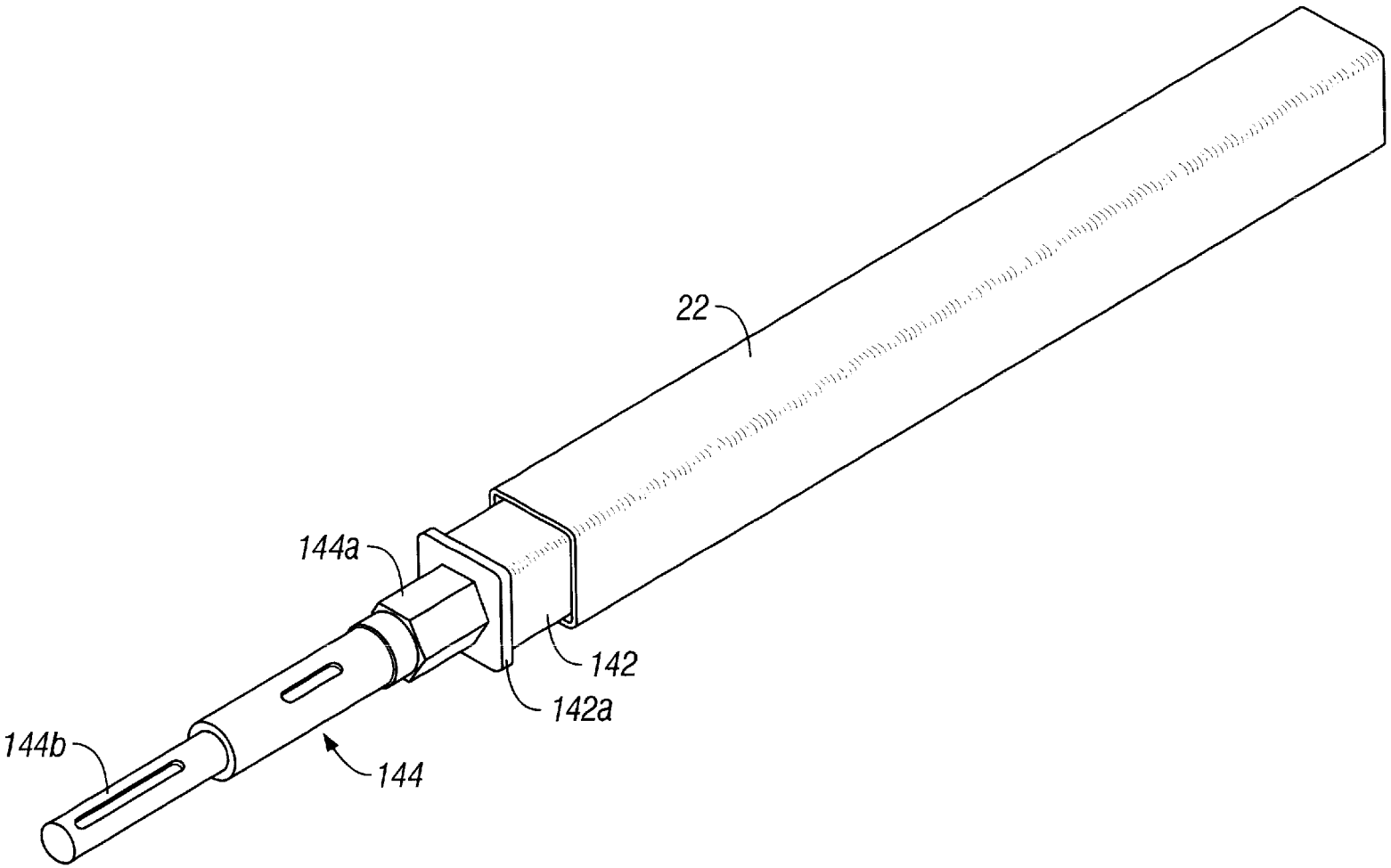
FIGS. 3 and 4 illustrate a preferred structure for rotatably mounting and driving the shafts of the first embodiment that carry the discs that classify the mixed recyclable materials.
Figure 4:
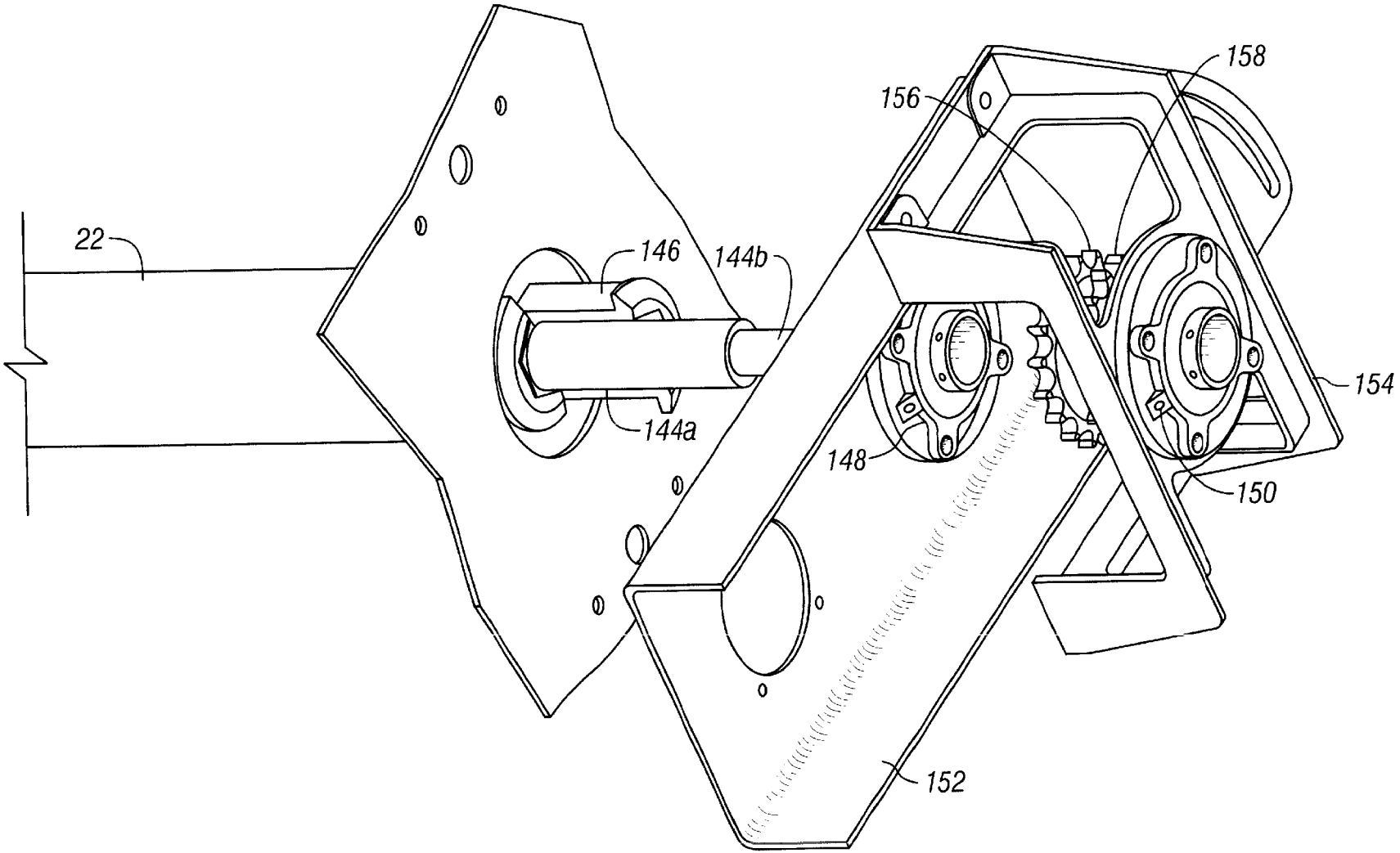

FIGS. 3 and 4 illustrate a preferred structure for rotatably mounting and driving the shafts 22 of the recycling apparatus 110. Each shaft 22 is preferably a hollow steel beam having a square cross-section. The square shape of the shaft 22 facilitates cutting off of twine, rope, plastic wrap, etc. that becomes tightly wrapped around the shafts 22 during the classification process. This wound material may be manually cut off the shaft 22 with a box cutter or other sharp knife. The use of square shafts 22 as the supporting axles for the discs 30 also allows them to be clamped around the shafts, or slid over the same, to achieve a positive driving engagement between the shafts 22 and the discs 30. Each of the discs 30 has a square aperture therethrough which receives its corresponding shaft 22. A molded polyurethane plug 142 (FIG. 3) having a square outer shape is inserted into the end of the shaft 22. Preferably the internal dimensions of the square interior of the shaft 22 and the outer dimensions of the plug 142 are selected to provide a tight fit. The plug 142 has a square shoulder 142*a* which limits the depth of its insertion into the shaft 22. A steel stub shaft 144 has a hexagonal shaped inner end 144*a* that fits snugly within a hexagonal interior opening in the plug 142. A cylindrical collar 146 (FIG. 4) fits over the outer portion of the hexagonal inner end 144*a*. A round outer end 144*b* of the stub shaft 144 is journaled in a pair of bearing assemblies 148 and 150 supported on a beam 152 and a U-shaped frame member 154. A pair of sprockets 156 and 158 are keyed to the round outer end 144*b* of the stub shaft 144 and have respective drive chains (not illustrated) entrained about the same. The use of the polyurethane plug 142 avoids any necessity of welding or otherwise securing the stub shaft 144, a collar or some other metal interface directly to the shaft 22. The plug 142 also aligns the rotational axis of the cylindrical stub shaft 144 with the rotational axis of the square shaft 22 and provides some beneficial shock absorbing characteristics. Other plastic materials besides polyurethane will suffice if they have sufficient strength and durability, such as DELRIN® plastic. The plug should be made of a resilient deformable material to allow a squeeze fit into the interior of the shaft 22.

Those skilled in the art of designing apparatus for classifying a stream of mixed recyclable materials will appreciate that the disc spacings, angles of inclination, and rotational speeds of the recycling apparatus 110 are selected to ensure that the rotating discs 30 will optimally classify and sort the input stream of mixed recyclable materials into three separate streams in order to achieve the highest percentage or degree of homogeneity of the portions.

FIGS. 5–8 illustrate a second embodiment of the present invention in the form of a V-shaped disc screen apparatus 170 including a V-shaped frame 172 made of welded hollow steel box beams. The apparatus 170 has a plurality of square shafts 174 whose ends are rotatably supported in the opposite sides of the frame 172. The shafts 174 are parallel and spaced apart and carry discs 176*a* and 176*b* that are interleaved between adjacent shafts 174. The shafts 174 and the discs 176*a* and 176*b* are divided into vertically inclined regions 180 and 182 on either side of a center line 178 of the frame 172. The frame 172 is supported on a base 184 that can be inclined in its own configuration, or variably inclined by lifting means (not shown) such as a jack screw or hydraulic cylinder so that a lowermost region of the interleaved discs 176*a* that form a trough 186 is slightly inclined moving from left to right in FIG. 6.

A stream of mixed recyclable materials is feed onto the trough 186 in a direction that is substantially parallel to the direction in which the shafts 174 extend. The stream of mixed recyclable materials is fed through an inlet opening 188 (FIG. 5) in one side wall of the frame 172 and onto the discs 176*a* of the trough 186. The mixed recyclable materials are agitated by the irregularly shaped discs 176*a* and broken glass, along with any other small refuse, falls through the discs 176*a* of the trough 186 and through the base 184 into a catch bin (not illustrated) or onto a conveyor (not illustrated). Newspaper is conveyed upwardly by the irregularly shaped discs 176*b* in the vertically inclined regions 180 and 182 and up and over the upper terminal ends of these regions, which are defined by the discs 176*b* mounted on the highest shafts 174. This newspaper falls onto separate conveyors (not illustrated). Large items such as bottles and containers migrate over the discs 176*a* of the trough 186 and fall off of the lower end thereof through an outlet opening 190 (FIG. 7) in the other side wall of the frame 172. These containers and other large articles drop into another bin (not illustrated) or onto another conveyor (not illustrated).

Figure 5:
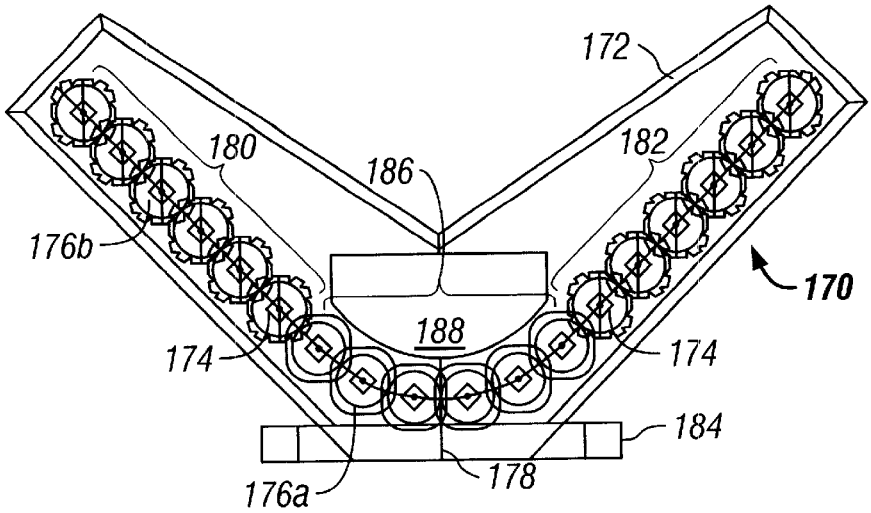
FIG. 5 is an elevation view of an infeed end of a second embodiment of the present invention.
Figure 6:
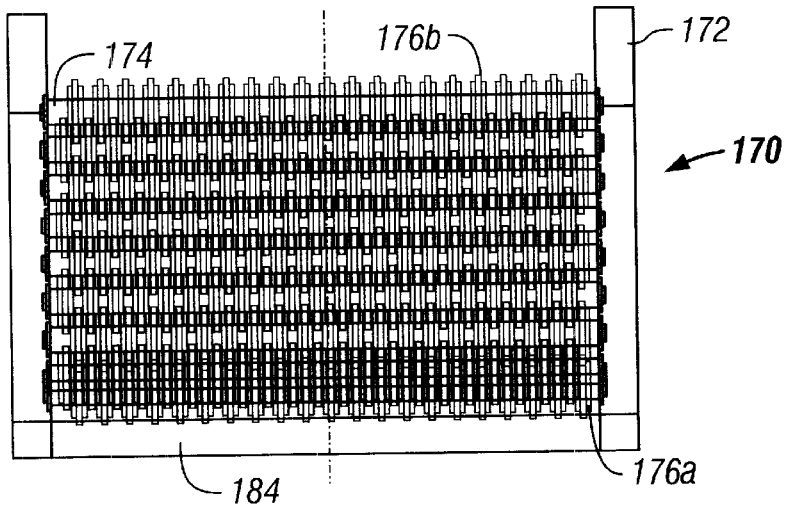
FIG. 6 is a side elevation view of the second embodiment.
Figure 7:
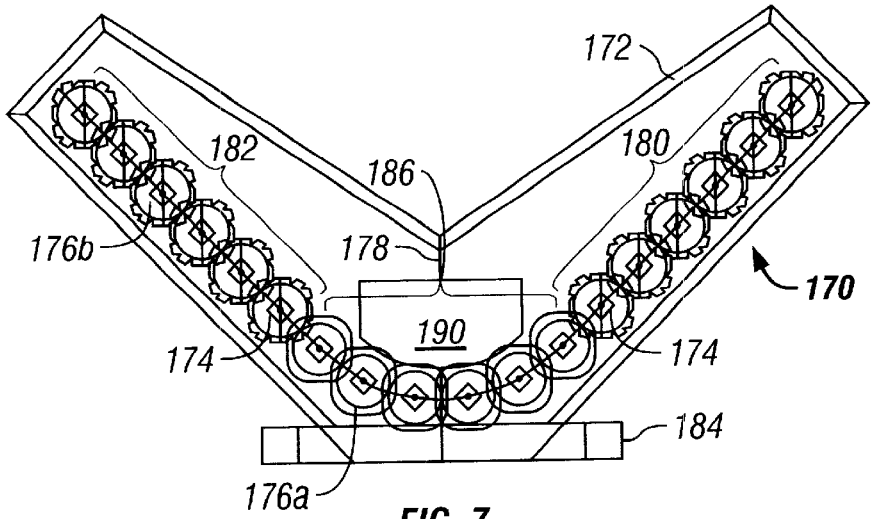
FIG. 7 is an elevation view of an outfeed end of the second embodiment.
Figure 8:
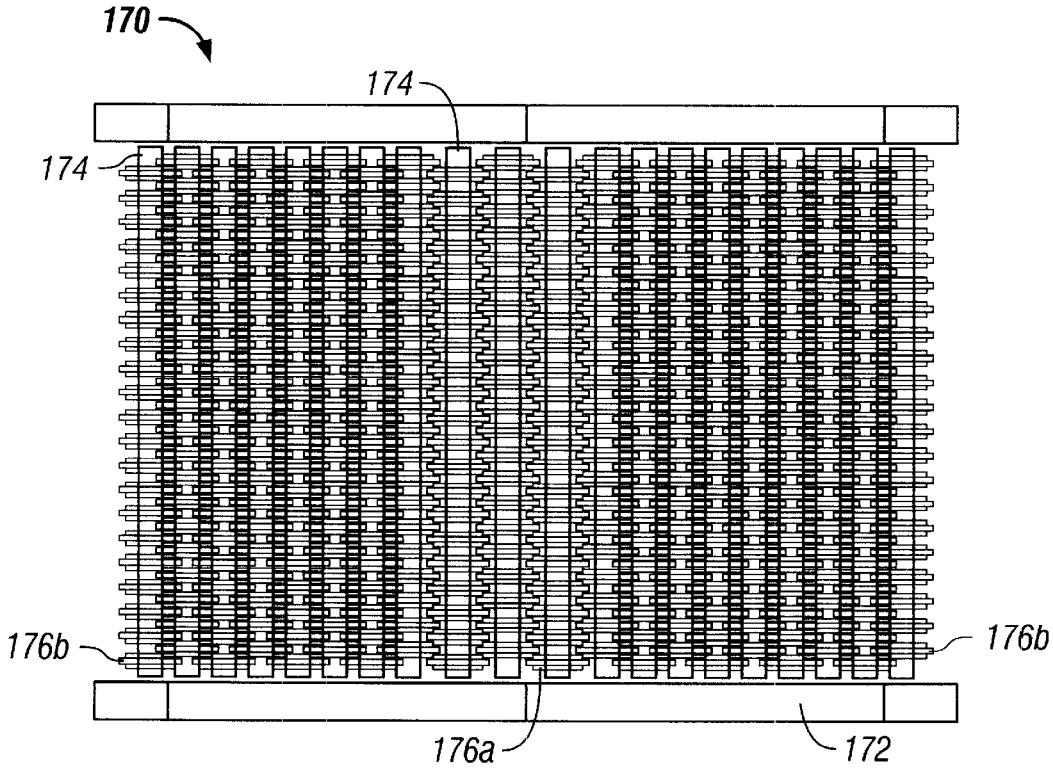
FIG. 8 is a top plan view of the second embodiment

As illustrated in FIGS. 5 and 7, the discs 176*a* of the trough 186 have a different exterior contour or shape than the discs 176*b* of the inclined regions 180 and 182. The lateral spacing between the discs 176*b* of the inclined regions 180 and 182 is larger than the lateral spacing between the discs 176*a* of the trough 186. Certain portions of the mixed recyclable materials such as mixed paper and cardboard and other debris falls between the spaces between the discs 176*b* of the inclined regions 180 and 182 for collection into other bins (not illustrated) or onto other conveyors (not illustrated). If desired, the V-shaped disc screen apparatus 170 can be equipped with air manifolds for pressing the newspaper against the discs 176*b* of the vertically inclined regions 180 and 182. Also, a fan can be positioned to blow air through the outfeed opening 190 (FIG. 7) to prevent newspaper from falling through this opening. Only a single fan or blower need be utilized instead of the multiple fans and blowers required at the lower end of inclined flat disc screens that have a relatively wide lower end.

A major advantage of my V-shaped disc screening apparatus over conventional planar screens that have been used to classify mixed recyclable materials is that the former can achieve high rates of separation with substantially fewer discs. This means that the V-shaped disc screen apparatus can take up much less space than the typical arrangement of multiple, overlapping planar screens. Since the containers are already deposited at the trough of the V-shaped disc screen apparatus they do not roll downwardly in a manner that impedes upward movement of newspaper.

Figure 9A:
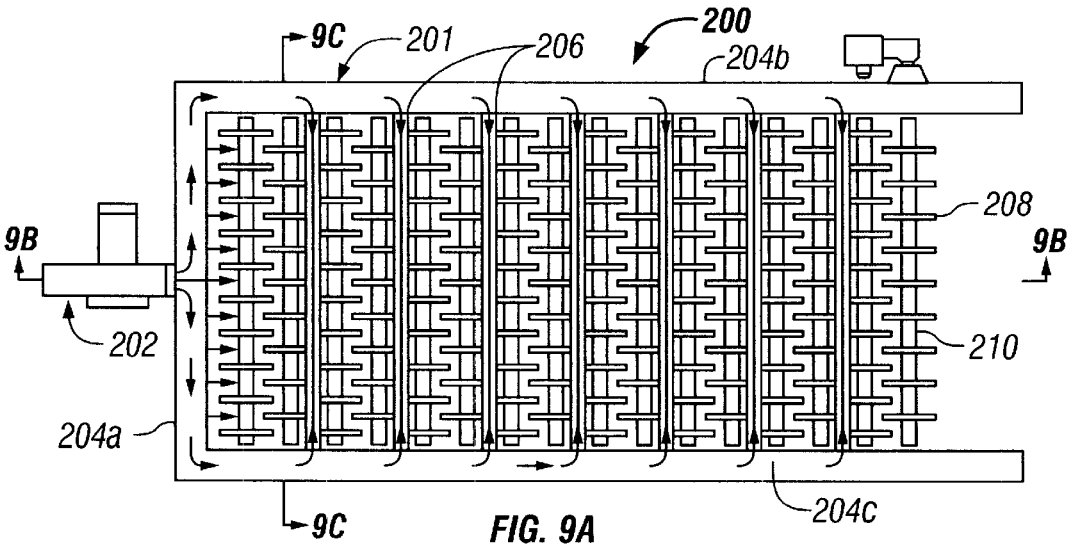
FIG. 9A is a top plan view of a third embodiment of the present invention that incorporates air ducting in its frame that feeds a plurality of air manifolds.
Figure 9B:
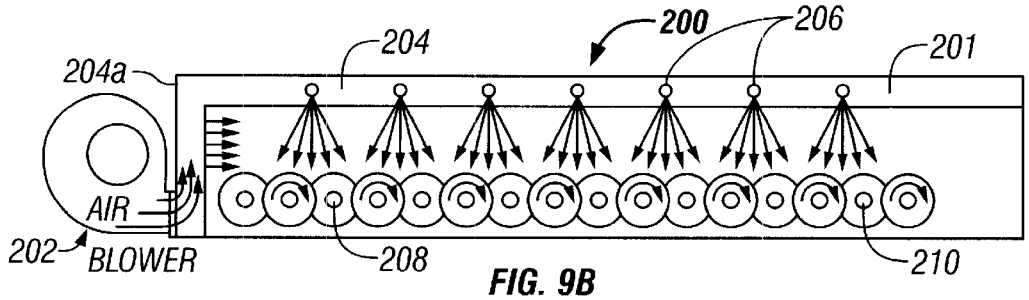
FIG. 9B is a longitudinal sectional view of the third embodiment taken along line 9B—9B of FIG. 9A.
Figure 9C:
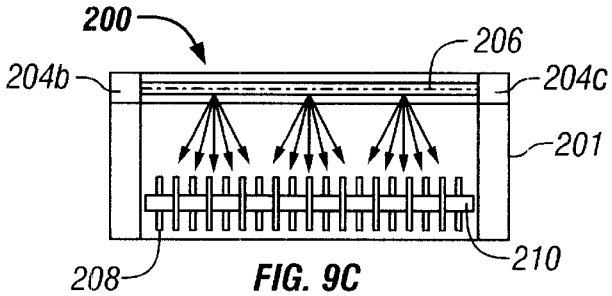
FIG. 9C is a cross-sectional view of the third embodiment taken along line 9C—9C of FIG. 9A.

FIGS. 9A, 9B and 9C illustrate a third embodiment of the present invention in the form of a disc screen apparatus 200 having a frame 201 made of hollow welded steel box beams. A blower 202 is coupled to a rear laterally extending box beam 204*a* so that pressurized air is conveyed through longitudinally extending box beams 204*b* and 204*c* that form opposite sides of the disc screen apparatus 200. A plurality of longitudinally spaced air manifolds 206 extend laterally across a plurality of discs 208 for blowing air downwardly toward the discs 208 as indicated by the arrows in FIGS. 9B and 9C. This helps convey a paper portion of a stream of mixed recyclable materials upwardly (left to right in FIGS. 9A and 9B) along and on top of the discs 208. The normal inclination of the disc screen apparatus 200 is not illustrated in FIG. 9B. The opposite ends of the air manifolds 206 are coupled to respective ones of the box beams 204*b* and 204*c* for receiving pressurized air therefrom. The air manifolds 206 preferably have a construction similar to those already described in conjunction with the recycling apparatus 110 of FIGS. 1 and 2. Thus the disc screen apparatus 200 advantageously has ducting within the frame 201 for connecting the source of pressurized air in the form of the output duct of the blower 202 to the air manifolds 206. In the preferred embodiment this ducting is provided in the form of hollow box beams 204*a*, 204*b* and 204*c*. The axes of the shafts 210 that carry the discs 208 extend in a common plane in the disc screen apparatus 200, but it will be understood that the shafts could have other arrangements, such as the V-screen arrangement illustrated in FIG. 1, for example.

Figure 10:
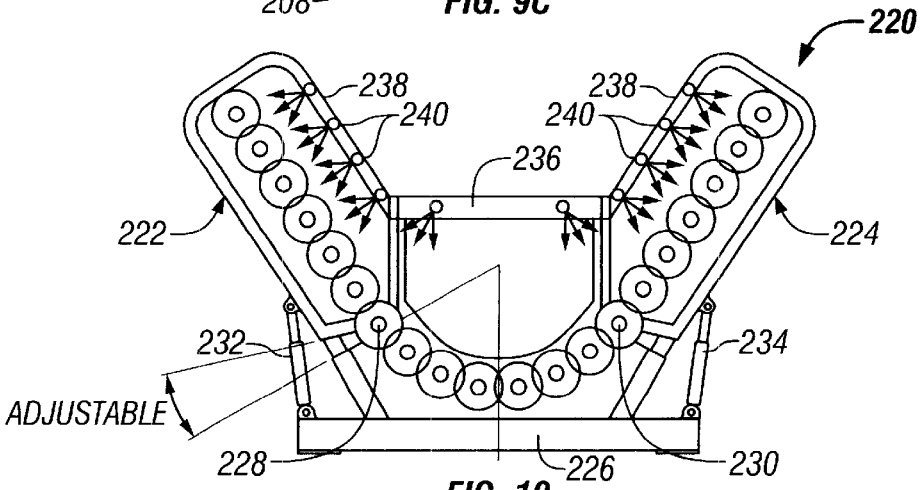
FIG. 10 is a diagrammatic side elevation view of a V-shaped disc screen with articulating inclined sections representing a fourth embodiment of the present invention.

FIG. 10 illustrates a fourth embodiment of the present invention in the form of a disc screen apparatus 220 having a V-shaped configuration. It is similar to the V-shaped disc screen apparatus 170 of FIGS. 5–8, except that its inclined sections 222 and 224 are pivotally mounted to a base frame portion 226 via pivot assemblies 228 and 230. In the fourth embodiment the pivot assemblies comprise selected ones of the shafts that support the discs. Lifting means in the form of hydraulic cylinders 232 and 234 are provided for independently varying the angle of inclination of the inclined sections 222 and 224 to adjust and optimize the separation of mixed recyclable materials. The lifting means 232 and 234 can be any other conventional lifting devices such as motorized jack screws, pneumatic lifters, and equivalent mechanical mechanisms used in heavy machinery to lift and move large frame members. The articulating V-shaped disc screen apparatus 220 also incorporates internal air ducting 236 and 238, which feed air manifolds 240, similar to those of the disc screen apparatus 200 illustrated in FIGS. 9A, 9B and 9C.

While I have described several embodiments of a recycling apparatus in accordance with the present invention, variations and modifications thereof will occur to those skilled in the art. Therefore, the protection afforded my invention should only be limited in accordance with the following claims.

What is claimed is:

1. A recycling apparatus, comprising:

a frame having a pair of sides spaced apart in a lateral direction and extending in a longitudinal direction;

a plurality of shafts rotatably mounted in the frame, the shafts being spaced apart along the longitudinal direction at progressively greater heights and extending in the lateral direction;

drive means for rotating the shafts;

a plurality of discs mounted on the shafts, the discs being dimensioned, configured and spaced apart in the lateral direction for classifying a stream of mixed recyclable materials deposited onto the discs as the discs are rotated by the drive means to convey a portion of the stream along an inclined conveying direction;

a source of pressurized air;

an air manifold extending laterally across the plurality of discs for blowing air to help covey the portion of the stream upwardly off of the discs by rotation of the discs; and ducting within frame for connecting the source of pressurized air and the air manifold, the ducting extending through at least one side of the frame.

2. The recycling apparatus of claim 1 wherein the ducting is comprised of hollow box beams forming at least a portion of the frame.

3. The recycling apparatus of claim 1 wherein the source of pressurized air comprises a blower operatively coupled to the ducting within the frame.

4. The recycling apparatus of claim 1 wherein the air manifold is mounted above the discs for blowing air downward toward the discs for pushing the portion of the stream against the discs.

5. The recycling apparatus of claim 1 wherein the axes of at least some of the shafts extend in a common plane.

6. The recycling apparatus of claim 1 wherein the shafts are arranged in a generally V-shaped configuration.

7. The recycling apparatus of claim 6 wherein the disc screen is also inclined along the lateral direction so that bottles and containers will travel laterally off of a lowermost region of the recycling apparatus.

8. The recycling apparatus of claim 1 wherein the air manifold includes at least one conduit extending in the lateral direction and having a plurality of laterally spaced nozzles.

9. The recycling apparatus of claim 8 wherein the conduit is formed of a segment of pipe with holes bored therein to form nozzles that eject streams of air toward the discs.

10. The recycling apparatus of claim 1 wherein the air manifold includes a plurality of conduits spaced apart along the longitudinal direction and extending in the lateral direction, each of the conduits having a plurality of nozzles spaced along the lateral direction.

11. A recycling apparatus for classifying a stream of mixed recyclable materials, comprising:

a frame including a base and a pair of inclined sections hingedly mounted to the base to define a generally V-shaped configuration;

a plurality of shafts rotatably mounted on the frame and spaced apart in a longitudinal direction at a plurality of different vertical heights to follow the generally V-shaped configuration;

a plurality of discs mounted on each of the shafts, the discs being laterally spaced along corresponding shafts and interleaved with the discs of adjacent shafts and defining a centrally located lowermost region and first and second vertically inclined regions extending from opposite sides of the lowermost region, the discs being shaped, spaced and configured for classifying a stream of mixed recyclable materials deposited onto the lowermost region;

means for rotating the shafts of a first portion of the lowermost region and the shafts of the first vertically inclined region adjacent thereto in a first direction;

means for rotating the shafts of a second portion of the lowermost region and the shafts of the second vertically inclined region adjacent thereto in a second direction;

the first and second vertically inclined regions being configured so that a portion of the stream of mixed recyclable materials deposited onto the lowermost region can be conveyed up the inclined regions and over a pair of terminal upper ends of the inclined regions; and lifting means for variably inclining the frame a selected amount so that another portion of the stream of mixed recyclable materials will be conveyed laterally off the lowermost region.

12. The recycling apparatus of claim 11 and further comprising a first air manifold for directing air downwardly against the discs of the first vertically inclined region and a second air manifold for directing air downwardly against the discs of the second vertically inclined region.

13. The recycling apparatus of claim 12 wherein the first and second air manifolds each include a plurality of laterally extending conduits each having a plurality of laterally spaced nozzles.

14. The recycling apparatus of claim 12 and further comprising a blower coupled to the first and second air manifolds.

15. The recycling apparatus of claim 14 wherein the blower and the air manifolds are coupled via ducting in the frame.

16. The recycling apparatus of claim 12 wherein the first and second air manifolds are positioned sufficiently close to the first and second vertically inclined regions so that containers that are partially conveyed upwardly along the first and second vertically inclined regions can tumble over the first and second air manifolds.

17. The recycling apparatus of claim 11 and further comprising a second lifting means for varying an angle of vertical inclination of the inclined regions of the frame.

18. The recycling apparatus of claim 11 wherein the discs each have an irregular outer contour for agitating mixed recyclable materials.

19. The recycling apparatus of claim 11 wherein the first lateral spacing between the discs of the lowermost region is less than the second lateral spacing between the discs of the first and second vertically inclined regions.

20. A method of classifying mixed recyclable materials, comprising the steps of:

providing a generally V-shaped disc screen with a lowermost region and a pair of vertically inclined regions, the lowermost region forming a trough inclined in a lateral direction;

depositing an incoming stream of mixed recyclable materials onto the trough;

passing a first portion of the mixed recyclable materials between a first plurality of discs in the trough to form a first stream of classified materials;

conveying a second portion of the mixed recyclable materials up and over a second plurality of discs in the vertically inclined regions of the disc screen and off a pair of upper terminal ends of the vertically inclined regions to form second and third streams of classified materials; and conveying a third portion of the mixed recyclable materials along the lateral direction over the trough and off of a lower end of the trough to form a fourth stream of classified materials.

21. A recycling apparatus for classifying a stream of mixed recyclable materials, comprising:

a frame having a pair of opposite sides and including a base and a pair of inclined sections hingedly mounted to the base to define a generally V-shaped configuration;

a plurality of shafts each having hollow ends;

means for rotatably mounting the ends of each of the shafts to the sides of the frame so that the shafts extend in a longitudinally spaced apart, substantially parallel relation, at a plurality of different vertical heights to follow the generally V-shaped configuration, including a resilient deformable plug inserted into an end of a corresponding shaft, a stub shaft inserted into a hollow interior opening in the plug, and at least one bearing assembly supported by a corresponding side of the frame, the stub shaft having a portion journaled in the bearing assembly;

means for rotating the shafts of a first portion of a lowermost region and the shafts of a first vertically inclined region adjacent thereto in a first direction;

means for rotating the shafts of a second portion of the lowermost region and the shafts of a second vertically inclined region adjacent thereto in a second direction;

the first and second vertically inclined regions being configured so that a portion of the stream of mixed recyclable materials deposited onto the lowermost region can be conveyed up the inclined regions and over a pair of terminal upper ends of the inclined regions; and lifting means for variably inclining the frame a selected amount so that another portion of the stream of mixed recyclable materials will be conveyed laterally off the lowermost region.

* * * * *